United States Patent [19]

Wojtowicz

[11] 4,374,168

[45] Feb. 15, 1983

[54] METALWORKING LUBRICATION

[75] Inventor: Wesley J. Wojtowicz, Fraser, Mich.

[73] Assignee: The H. A. Montgomery Co., Inc., Detroit, Mich.

[21] Appl. No.: 318,849

[22] Filed: Nov. 6, 1981

[51] Int. Cl.[3] ..... B32B 7/02; B05D 1/18; B21B 45/02; B32B 15/04

[52] U.S. Cl. ..... 428/212; 72/42; 72/46; 252/9; 252/11; 252/DIG. 3; 427/409; 427/443; 428/215; 428/216; 428/334; 428/335; 428/336; 428/409; 428/467

[58] Field of Search ..... 428/467, 457, 212, 215, 428/216, 332, 334, 409; 427/409, 327, 443, 336; 72/42, 46; 252/911, DIG. 3

[56] References Cited

U.S. PATENT DOCUMENTS

| | | | |
|---|---|---|---|
| 3,568,486 | 3/1971 | Rosenberg et al. | 427/409 X |
| 3,754,942 | 8/1973 | Moradian | 428/467 X |
| 3,984,599 | 10/1976 | Norton | 428/467 X |
| 4,321,308 | 3/1982 | Jahnke | 428/457 X |

*Primary Examiner*—Thomas J. Herbert, Jr.
*Attorney, Agent, or Firm*—Pearne, Gordon, Sessions, McCoy & Granger

[57] ABSTRACT

Oil-type, deep drawing lubricants for use primarily on ferrous sheet metal surfaces and the like may consist essentially of a dispersion of from about 2 to 20 parts by weight of a high viscosity liquid polar lubricant dispersed as a discontinuous phase in an anhydrous, hydrocarbon, liquid vehicle of relatively low viscosity with the aid of at least one emulsifying agent. The lubricants preferably contain at least one corrosion-inhibiting agent and at least one agent for facilitating removal of the lubricant composition from the surface of a fabricated workpiece. The lubricants may be applied to a workpiece at the steel mill or in a blanking line by conventional liquid lubricant application procedures as thin films in which the dispersed phase quickly splits from the continuous phase and forms an ultra-thin, adherent film overlaid by a thin film of the material of the continuous phase.

19 Claims, No Drawings

METALWORKING LUBRICATION

The present invention relates to oil-type, deep drawing lubricants for use on ferrous and nonferrous sheet metal surfaces that are to be severely deformed in a cold state by stamping or other conventional metal drawing operations. More particularly, the invention relates to anhydrous, liquid, deep drawing lubricant compositions that may be applied to the surfaces of metal workpieces by spraying, dipping, roll-coating, or swabbing, or by drip application and spreading with a wiper blade, or by variants of those several conventional methods of application.

The lubricant compositions of the invention are suitable for use on, for example, hot or cold-rolled carbon steels, steel alloys (including stainless steel, galvanized iron and steel, "Zincrometal" (a product of Diamond Shamrock Corp.), copper, brass, bronze, aluminum, aluminum alloys, and the like.

BACKGROUND OF THE INVENTION

It is generally known that the effectiveness of oil-type drawing lubricants is, in large part, a function of their viscosity. It is also generally known that an extremely thin film (of the order of 50 microinch) of a relatively high viscosity lubricant is adequate to permit the fabrication of metal by severe stamping operations or the like if the lubricant possesses the other necessary physical properties. However, in order to coat surfaces with high viscosity lubricants, it has been necessary to apply them with the aid of steel rolls under high pressure. In spite of all efforts, it has seldom been possible for high viscosity lubricant films of less than 200 microinch in thickness to be applied in this manner. Most often, the resulting film thicknesses were around 1000 microinch or more in thickness. As a result, from around 4 to 20 or more times the necessary quantity of high viscosity lubricants has been applied in this manner at wastefully excessive material costs.

When flat, metal workpiece blanks are coated with viscous, oil-type lubricant films of 200 microinch or more in thickness, separation of the blanks for feeding them to the deforming operations is difficult. Therefore, since the application of thinner films has not been readily achieved or controllable heretofore, the use of high viscosity, oil-type lubricants on metals to be deformed has generally been restricted to applying the viscous lubricants to workpiece blanks immediately prior to placing the blanks into die cavities in which they are to be worked. This is undesirable because the excessive amounts of oil applied leave heavy, residual oil films on the formed metal parts. Such heavy residual oil films, if not removed, interfere with frequently required welding, adhesive bonding, and painting of the formed parts, and it is desirable, therefore, to produce the formed metal parts with as little residual oil as possible left on their surfaces. Moreover, the application of oil type lubricants immediately prior to their movement into deforming dies or the like creates serious housekeeping problems around the presses and requires much wasted time cleaning the die bed areas of oil before press adjustments and repairs can be made safely and efficiently.

Among the expedients heretofore employed to overcome the lubricant application problems discussed above is the dispersion of a viscous drawing lubricant in the form of an aqueous emulsion and applying the emulsion to the metal in the proper quantity to deposit the desired thin film of viscous lubricant on the metal surface. Good lubricant performance has been obtained in this way, but it is not practical to precoat the metal in this way at steel mills or in blanking operations at the place of use of the metal because the water of the emulsions causes troublesome corrosion of the metal prior to its use. Also, precoating the metal in this way at blanking lines causes dangerous load shifting of the stacked wet blanks and messy and dangerous housekeeping conditions around the blanking lines. The need for drying of the emulsions after their application precludes applying them to the blanks as the blanks are moved from stacks into the metalworking operations.

Another expedient heretofore employed to overcome the lubricant application problems discussed above is to apply the viscous lubricant as a solution of the lubricant in a volatile solvent which, upon subsequent evaporation, leaves the desired thin film of viscous lubricant on the metal surface. However, this creates a serious fire hazard and toxicity problems for personnel in the coating and drying areas, whether the operations are performed at the mill or at a later time. Furthermore, the space requirements for the coating and drying operations are generally not available either at the mill or at fabricating plants. Also, facilities normally not present at either type of plant are required and such facilities, therefore, are not easily made a part of existing operations of mills or fabricating plants in a cost effective manner. These latter problems are particularly acute at mills where metal sheet being produced is moving at high speed, sometimes in excess of 2,000 feet per minute, so that it is impractical to provide time for solvent evaporation after the metal has been coated and before it is coiled.

Still another expedient heretofore employed to overcome the lubricant application problems discussed above is to apply various specially selected viscous lubricants in solutions in a less viscous, nonvolatile, nonaqeous carrier liquid, such as a mineral oil of insufficient viscosity to serve, alone, as an adequate deep drawing lubricant. The lubrication obtainable from the carrier liquid alone can be significantly increased in this manner by dissolving any of a variety of selected, high viscosity, high pressure lubricants in the carrier liquid without increasing its viscosity to an unmanageable degree (i.e., to a degree that would tend to recreate the application problems sought to be overcome). However, so far as we are aware, such composition have not provided sufficiently low coefficients of friction in severe deep drawing operations commonly performed in the metalworking industry.

Yet another expedient heretofore employed to overcome the lubricant application problems discussed above is, first, to apply and bond a solid resin polymer coating to the metal to be worked, preferably at the steel mill, and subsequently to apply an overlay coating of a relatively low viscosity oil or the like immediately prior to fabrication of the metal, as taught in U.S. Pat. No. 3,568,486. In accordance with that patent, the resin polymer coating and overlay coating are selected so that the latter coating softens the former coating through part of its thickness without impairing its bond to the metal, and the softened portion of the coating serves as a high pressure lubricant while the unsoftened portion, still bonded to the metal, protects the surface of the metal from scuffing. Although that process has been widely used with outstanding success in protecting the metal from corrosion and surface marring prior to fabrication and in providing lubrication during severe deep drawing operations, it is a relatively costly process because the resin polymer is expensive and two separate coating steps are required. Moreover, the process of that patent is also not practical for use in mills in which metal being rolled is moving at high speed.

SUMMARY OF THE INVENTION

In accordance with the present invention, ultra-thin films of a high viscosity, liquid, polar, deep drawing lubricant are deposited upon the surface of the metal to be worked from a dispersed phase of the high viscosity lubricant suspended in a relatively low viscosity carrier liquid vehicle in which the high viscosity lubricant is substantially insoluble. In order to prepare such dispersions in a stable condition, it is necessary, of course, to incorporate a suspending agent and/or an emulsifier therein.

When such dispersions are applied to metal surfaces in layers ranging in thickness from about 200 to about 500 microinch, the dispersed phase separates from the carrier and deposits as an ultra-thin film of the high viscosity lubricant that wets and adheres to the metal surface, and the relatively nonvolatile carrier overlies the high viscosity film. The high viscosity lubricant film may suitably range in thickness from about 200 microinch or so. The overlying, low viscosity carrier liquid may or may not contribute significantly to the lubrication provided by the underlying high viscosity lubricant film.

When using the present invention, a corrosion inhibitor is preferably incorporated in the dispersions of the invention, consistent with common practice when using other lubricant coating systems. Also, surfactants, saponifiable oils, and coupling agents are preferably incorporated in the dispersions of the invention, as in the lubricant coatings of other systems, to facilitate removal of the lubricants from the fabricated workpieces as required by subsequent welding, painting, or other product finishing operations. However, these common expedients are not essential to the invention.

The foregoing and other features and advantages of the invention will be more fully understood and appreciated from the ensuing, more detailed description of the invention and how it may be employed.

DETAILED DESCRIPTION OF THE INVENTION

Typical lubricant compositions according to the present invention may contain from as little as 2% and up to as much as 20% of a viscous, polar, discontinuous lubricant phase preferably having a viscosity of about 1000 to about 5000 cSt or more at 20° C. The balance of the composition is a continuous phase of a liquid, hydrocarbon, dispersing medium, carrier, or vehicle having a viscosity in or near the range of 10 to 100 cSt at 20° C. In specifying such a range of proportions of the discontinuous and continuous phases of the compositions, the necessary emulsifiers and optional surfactants, coupling agents, and saponifiable oils are soluble in and are considered to be parts of the continuous dispersing medium, whereas, any extreme pressure additives that may be incorporated in the compositions to enhance lubrication under boundary conditions may be parts of either phase and should be considered accordingly (i.e., as parts of the phase in which they exist in the compositions). Depending upon its solubility in the other components of the compositions, an extreme pressure additive may be incorporated in either of the two phases. It is preferable that it be soluble in and a part of the dispersed phase, of which it may be the principal lubricant component in special cases, or even the sole lubricant forming the dispersed phase.

The polar lubricants of the discontinuous phase of the compositions, although of relatively high viscosities, are nevertheless liquids, and a wide variety of such high viscosity lubricants may be employed. Examples of polar lubricants which have been found to be suitable for use as high viscosity lubricants in accordance with this invention (depending upon the particular dispersing medium employed) and the viscosities of these polar lubricants are as follows:

| Item No. | Polar Lubricant | Viscosity (cSt at 20° C.) |
|---|---|---|
| 1 | Ucon 50 HB 2000 | 1,000 |
| 2 | Cymel 303 | 3,000 |
| 3 | Blown castor oil | 3,500 |
| 4 | Keil CW-225 | 8,600 |
| 5 | Empol 1022 dimer acids | 10,000 |
| 6 | Blown soya bean oil | 14,000 |
| 7 | Emery 9874 acids | 30,000 |
| 8 | Rosin oil (destructively distilled rosin) | 40,000 |

The chemical nature and United States sources of the above-tabulated polar lubricants identified in the above list by trademarks are as follows: Ucon 50 HB 2000 is a polyalkylene glycol product of Union Carbide Corp., Chemical Div.; Cymel 303 is a hexamethoxymethyl melamine product of American Cyanamid Co.; Keil CW-225 is a chlorinated paraffin wax product of Keil Chemical Div. of Ferro Corp.; Empol 1022 dimer acids are dimers of unsaturated vegetable oil acids, and Emery 9874 acids are polymerized unsaturated vegetable oil acids, both being products of Emery Industries, Inc. It is important to note further that Items Nos. 4, 5, 6, and 8 in the above table are soluble in naphthenic mineral oils but are insoluble and, therefore, may be dispersed in petroleum base paraffinic oils of 10 to 100 cSt or so at 20° C. for use in accordance with this invention. Items 1, 2, 3, and 7 in the above table, on the other hand, are substantially insoluble in naphthenic oils, and may be dispersed therein without significant dissolving for use in accordance with this invention. The importance of such solubility characteristics has been indicated above, but is explained further below.

The relatively low viscosity, liquid, hydrocarbon dispersing medium, carrier, or vehicle constituting the continuous phase of the compositions, likewise, may be any of a number of hydrocarbon liquids, most suitably light petroleum hydrocarbon fractions selected according to the particular high viscosity, polar lubricant employed (or vice versa).

The high viscosity, polar lubricant selected for use with a particular low viscosity, hydrocarbon dispersing medium, or the low viscosity, hydrocarbon dispersing medium selected for use with a particular high viscosity, polar lubricant, is determined by solubility and miscibility considerations. In order to obtain the desired low coefficient of friction between the workpiece and the dies by which the workpiece is to be deformed in severe, deep drawing operations, it has been found essential for such selections to be made so that the high viscosity, polar lubricant is substantially insoluble in the low viscosity, hydrocarbon, dispersing medium. Thus, in making such selections, a distinction must be drawn between various potentially suitable dispersing media derived from petroleum oils according to the origin of the petroleum oils or the manner in which they have been processed. For example, low viscosity petroleum derivatives from naphthenic base oils exhibit far greater solvency for many of the potentially suitable high viscosity polar lubricants than do the derivatives of neutral oils of low aromatic content obtained, for example, by solvent refining. As a result, such neutral oil derivatives in which particular high viscosity polar lubricants are substantially insoluble are suitable for use with such high viscosity polar lubricants in accordance with the invention, whereas, naphthenic oil derivatives of the same viscosity as the neutral oil derivatives are distinctly inferior for use with the same high viscosity polar lubricants, but are entirely suitable for use with other high viscosity polar lubricants that are substantially insoluble in the naphthenic oil derivatives. This is true despite the fact that the neutral oil derivatives and the derivatives of naphthenic base oils being compared, when used alone, generally produce identical coefficients of friction in standard sliding friction tests. This distinction between such potentially useful petroleum hydrocarbon dispersing media is illustrated by the following Example 1:

EXAMPLE 1

Utilizing a standard sliding friction test as described in a paper entitled "Sliding Friction Test for Metalworking Lubricants," by W. J. Wojtowicz, LUBRICATION ENGINEERING, May–June 1955, the coefficient of friction produced by four test compositions was determined utilizing the following test conditions: Load—20,000 lbs; Unit Pressure—5,000 psi; Speed—4 in./min.; Metal—CR Steel; Surface Roughness—10 microinch. The four compositions tested were: a naphthenic oil derivative having a viscosity of 50 cSt. at 20° F.; a solvent-refined neutral oil derivative having the same viscosity; the same naphthenic oil derivative plus 10% by weight of a chlorinated paraffin wax containing 40–50% chlorine (KIEL CW-225) dissolved therein; and the same solvent-refined neutral oil derivative plus 10% by weight of the same chlorinated paraffin wax dispersed (but not dissolved) therein. The coefficients of friction produced by these four compositions were as shown in the following Table 1:

TABLE I

| Composition | Coefficient of Friction |
|---|---|
| Naphthenic oil | 0.030 |
| Solvent-refined neutral | 0.030 |
| Naphthenic oil + 10% CW-225 | 0.023 |
| Solvent-refined neutral + 10% CW-225 | 0.009 |

In order to produce lubricant compositions according to the invention that can be economically marketed and/or stored for later use in a metal fabricating plant, it is preferred to make a concentrate of the high viscosity polar lubricant dispersed in a relatively small amount of the low viscosity dispersing medium. At the point of use, more of the same or another, appropriate, low viscosity, dispersing medium is added to the concentrate in an amount most suitable for any particular metal deforming operation to be performed. However, this is only a convenience that is commonly employed in the marketing of metalworking lubricants for use by others, and is not otherwise important. If desired, the high viscosity lubricant may simply be mechanically dispersed in the low viscosity carrier at the point of use, so long as separation of these components of the dispersion does not occur until the dispersion has been applied to the metal to be lubricated.

In preparing 330 parts of such a concentrate for later use, one may first prepare an organic clay dispersion by mixing 10 parts of an activated clay (suitably "Claytone 40" sold in the United States by Southern Clay Products Co.) with 86.7 parts (by weight) of a petroleum hydrocarbon having a viscosity of about 20 cSt at 20° C. and heating the mixture to 70°–80° C. By then adding 3.3 parts of propylene carbonate and stirring for about 30 minutes, the clay becomes substantially colloidally dispersed in the liquid. 200 parts of Emery 9874 acids (see above) and 30 parts of Monazoline-O emulsifier (a substituted imidazoline of oleic acid sold in the United States by Mona Industries, Inc.) are then stirred into the colloidal clay suspension to produce a stable, marketable concentrate. All parts and percentages not so designated hereinafter are parts or percentages by weight.

Suitably for many severe metalworking applications, 1320 parts of petroleum hydrocarbon of a viscosity of 80 cSt at 20° C. may be added to such a concentrate with stirring (a 4:1 dilution) to produce the final lubricant composition. A typical final lubricant composition prepared in this manner contains about 12% of the Emery 9874 acids constituting the high viscosity polar lubricant.

The emulsifier used in preparing concentrates of the compositions of the invention should be cationic. Cationic emulsifiers used in conjunction with the activated clay ensure a stable suspension of the lubricant upon dilution with a hydrocarbon diluent. Typical cationic emulsifiers suitable for this purpose are: Armeen 8D, an oil-soluble primary alkyl amine, and Ethomeen C/12, an oil-soluble ethylene oxide condensate of a fatty amine, both being sold in the United States by Armak Industrial Chemical. Monazoline-O, used in the preparation of a marketable concentrate as described above, is another example and is an often preferred one because it enhances the corrosion-inhibiting character of the compositions.

The concentrate described above may be modified to accept higher than 4:1 dilutions by increasing the amount of organic clay. In general, the following ranges of proportions for the concentrated base and for the diluted, final drawing lubricant composition will be found to be satisfactory:

| | Percent/Weight |
|---|---|
| Concentrated Base | |
| High viscosity polar lubricant | 50–66 |
| Organic clay | 2–4 |
| Clay dispersing agent | 1–2 |
| Cationic emulsifier | 5–10 |
| Petroleum hydrocarbon diluent | 20–30 |
| Final Drawing Lubricant | |
| High viscosity polar lubricant | 5–20 |
| Organic clay | 0.4–1.3 |
| Clay dispersing agent | 0.2–0.7 |
| Cationic emulsifier | 1.0–3.3 |
| Petroleum hydrocarbon diluent | 70–90 |

Typically, the final drawing lubricant may also contain 1–3% or so by weight of one or more of the corrosion inhibitors discussed below, a cleaning or removal aid in an appropriate amount as explained below, and up to about 15% by weight of an extreme pressure lubricant. All of these may be included in the concentrated base. The extreme pressure lubricant may be more of the same high viscosity polar lubricant constituting the primary lubricating component of the invention, or it may be an extreme pressure additive compatible therewith and dissolved therein, or it may be an extreme pressure additive compatible with and dissolved in the low viscosity petroleum hydrocarbon diluent or carrier. The most frequently used extreme pressure additives are organic compounds containing chlorine, sulfur, phosphorus, or a combination of two or all three of those elements. The inclusion of such additives in the lubricant compositions of the invention enables them to perform characteristically in upgrading the ability of the invention to meet the lubrication demands of severe metal forming operations.

It is generally desirable to add one or more corrosion inhibitors to the lubricant compositions of the invention to enhance the corrosion protection that would otherwise be provided. Such addition agents should be selected with care, since some corrosion-inhibiting agents employed in drawing lubricant compositions cause serious problems later when welding operations are performed on the fabricated metal parts. Corrosion inhibitors found to be suitable for use in the compositions of the invention are numerous members of a large group consisting of organic amine and metallic salts of organic sulfonates, petroleum oxidates, organic diamines, organic amine condensates of fatty alcohols, and substituted imidazolines. If the residual lubricant films on the fabricated parts are not to be removed in a cleaning operation, and if welding through such residual films is necessary, corrosion inhibitors that leave a negligible ash residue upon ignition are preferably selected from the many possibilities indicated. Examples meeting this requirement are: Alox 319-FX, a petroleum oxidate sold in the United States by Alox Corp.; Hodag LA-1003, a fatty-based amine condensate sold in the United States by Hodag Chemical Corp.; and Monazoline-O used primarily as an emulsifier as stated above.

In order to facilitate removal of the lubricant compositions of the invention from the fabricated metal parts as required by subsequent welding, painting, plating, or other product finishing operations, any of various surfactants, coupling agents, and saponifiable oils may be incorporated in the lubricant compositions. The fabricated metal parts are frequently cleaned by immersion in or spraying with an aqueous alkaline cleaner used at a relatively low ambient temperature, or at an elevated temperature. For effective cleaning with such a cleaner, the lubricant compositions described above should generally contain additional oil-soluble emulsifiers such as organic sulfonates, esters of fatty acids, polyoxyethylene acids, and alcohols and alkanolamides, the latter generally being preferred. As little as 2% by weight in the lubricant composition of an added alkanolamide such as Pearsall OA-154 (a diethanolamine/fatty acid condensate sold in the United States by the Pearsall Division of Witco Chemical Corp.) will generally enable residual lubricant films to be removed in about 30 seconds with aqueous alkaline cleaners at about 60° C. Higher concentrations of the alkanolamide or other added emulsifiers in the lubricant compositions are required at lower cleaning solution temperatures. As an alternative approach to the residual film removal problem, the lubricant composition may be formulated using oil-soluble vegetable oil fatty acids as the high viscosity polar lubricant so as to enhance the removability of residual lubricant films with a mild aqueous alkali wash.

The following are examples of lubricant compositions according to the invention that have been utilized with excellent results, as subsequently described:

EXAMPLE 2

| Ingredients | Percent/Weight |
|---|---|
| Naphthenic oil, 80 cSt at 20° C. | 73.58 |
| Emery 9874 acids* | 11.00 |
| Pearsall OA-154* | 11.00 |
| Monazoline-O* | 2.00 |
| Alox 319-FX* | 1.50 |
| Claytone 40* | 0.69 |
| Propylene carbonate | 0.23 |

*These compositions have been identified above.

Example 2 above sets forth a formulation suitable for application to sheet steel while it is moving from a roll through a flex-roll straightener or through a blanker line, or for application to individual blanks as they are fed to a metal drawing press. In this example, the polymerized fatty acid component constituting the high viscosity polar lubricant is insoluble in the naphthenic oil constituting the major part of the hydrocarbon dispersing medium. A relatively high percentage of the emulsifier component is present in this example to permit subsequent removal of the lubricant film from the fabricated workpiece by washing with mildly alkaline solutions at ambient temperature. The Alox 319-FX and Monazoline-O components are corrosion inhibitors selected to provide prolonged corrosion protection of stampings which may go into storage or be shipped long distances, or which may require such protection for long periods of time prior to being painted or otherwise provided with a surface protecting finish. The Claytone 40 activated organic clay is dispersed in the naphthenic oil components with the aid of the propylene carbonate in order to stabilize the suspension of the Emery 9874 polymerized fatty acid components in the naphthenic oil.

The effectiveness of the composition of Example 2 has been demonstrated by comparison with a standard, heavy duty, emulsified drawing compound formulated with chlorinated paraffin wax from the following ingredients:

| Ingredients | Percent/Weight |
|---|---|
| Chlorinated paraffin wax (40% Cl) | 20 |
| Sodium salt of tallow fatty acids | 3 |
| Tallow acids | 3 |
| Acrylic polymer (thickener) | 1 |
| Water | 73 |

In this comparison, 5,000 steel blanks to be pressed into control arms for automotive suspension systems were produced from a single coil of 0.060 inch thick cold-rolled steel and were divided into two equal lots. The composition of Example 2 was applied to the blanks of one of these lots by a roll coating operation to provide a coating level of 200 microinch. One gallon of the composition of Example 2 was sufficient for this purpose. All but seven of the 2,500 control arms pressed from this lot of blanks were perfectly formed. It was determined that the other seven control arms were imperfectly formed because of surface defects in the blanks from which they were pressed. The other lot of 2,500 blanks was coated with the comparison emulsified drawing compound identified above. This second lot of blanks was then pressed in the same press to form control arms, all of which were perfectly formed. Fifteen gallons of the standard heavy duty, emulsified drawing compounds were required in the processing of the second lot of 2,500 blanks compared to the one gallon of the composition of Example 2 required in the processing of the first lot of 2,500 blanks. Thus, the composition of Example 2 effected an 85% saving in lubricant volume and 70% saving in lubricant cost and produced none of the hazardous contamination around the press resulting from the use of the standard, heavy duty, emulsified drawing compounds.

The effectiveness of the composition of Example 2 was further demonstrated in the fabrication of reinforcement bars constituting parts of automobile door assemblies. These bars had previously been fabricated from 0.070 inch thick high strength steel using a standard, emulsified, chlorinated paraffin drawing compound fortified with calcium carbonate and formulated from the following ingredients:

| Ingredients | Percent/Weight |
|---|---|
| Chlorinated paraffin wax (40% Cl) | 20 |
| Calcium carbonate | 6 |
| Sodium salt of petroleum sulfonate | 3 |
| Tallow acids | 3 |
| Sodium salt of carboxy methyl cellulose | 1 |
| Water | 67 |

In such prior fabrication of these reinforcement bars, fractures frequently occurred in an isolated area of the bars where it is necessary to form a small, cuplike indentation. When 900 blanks were roll-coated with the composition of Example 2 to deposit film thicknesses of 200–300 microinch and pressed into such reinforcement bars on the same press, all 900 of the bars were produced with no fractures, although a slightly higher, but acceptable, degree of scoring was observed on sidewalls of the bars. Only 5 pounds of the lubricant of Example 2 was required in producing the 900 test bars, whereas several times as much of the above-identified standard lubricant would normally have been required.

Still another demonstration of the effectiveness of the composition of Example 2 was made in the fabrication of automobile bumpers previously stamped from prepolished blanks that had been phosphated and coated with a commercial dry soap and borax film. When the composition of Example 2 was substituted for the soap and borax film, 600 bumpers were fabricated with equally acceptable results, thus demonstrating the practicality of reducing the high energy costs and control problems inherent in producing the soap and borax coatings from a hot soap and borax solution.

EXAMPLE 3

| Ingredients | Percent/Weight |
|---|---|
| Naphthenic oil, 80 cSt at 20° C. | 73.55 |
| Blown castor oil | 15.00 |
| Castor oil fatty acids | 7.50 |
| Monazoline-O* | 2.00 |
| Hodag LA-1003* | 1.00 |
| Clayton 40* | 0.70 |
| Propylene carbonate | 0.25 |

*These compositions have been identified above.

Example 3 sets forth a formulation particularly suitable for application to sheet steel at the steel mill before the sheet is coiled into rolls for shipment. Blown castor oil is a preferred high-pressure polar lubricant for this purpose because it has a minimum interaction with the steel as compared with the polymerized fatty acids of Example 2. Relatively small quantities of emulsifiers are employed in the composition of Example 3 because rolls of sheet steel are commonly exposed to atmospheric conditions for prolonged periods of time before use, and emulsifiers in general tend to promote the condensation of atmospheric moisture within the coil wraps of the rolls during shipping and storage under varying temperature conditions. The castor oil fatty acids function as nonionic surfactants and are used instead of a water-sensitive emulsifier to assist in removing residual lubricant films from the formed workpieces with aqueous alkaline cleaners. The Hodag LA-1003 amine condensate component of Example 3 serves as a corrosion inhibitor.

The effectiveness of the composition of Example 3 was demonstrated by using it in the fabrication of miniature electronic, cuplike components measuring 0.75 inch in diameter and 0.5 inch deep in a variety of configurations formed from 0.018 inch to 0.025 inch cold-rolled steel. The forming of such parts involved piercing, punching, bending, and severe wiping of the metal and, because of severe tool wear, has heretofore frequently been performed on copper-plated steel. Alternatively heretofore, an acrylic polymer coating and an overlay oil have been used as described in the above-mentioned U.S. Pat. No. 3,568,486 for minimizing tool wear. The use of copper-plated steel and the use of the patented two-coat process both added significantly to the cost of the final product. In the comparative tests, the composition of Example 3 was roll-coated to a film thickness of about 200 microinch onto a 24-inch wide coil of 0.018 inch cold-rolled steel. The coated coil was then slit into a number of narrower coils varying in width from 0.5 inch to 1.0 inch. Over 250,000 components were fabricated from these narrow coils. There was no significant wear observed on the tools after completion of the test run.

The foregoing examples of presently preferred lubricant compositions according to the invention and the demonstrations of their effectiveness and economy when substituted for drawing lubricants previously employed in high volume commercial operations attest to the merits of the present invention. The additional consideration that compositions according to the present invention can be applied to cold-rolled steel at the steel mill further indicates the practical value of the present invention for improving the state of the art of sheet metal forming in many industrial areas.

A characteristic of the principal lubricating components of compositions according to the present invention is the normal insolubility and immiscibility of the high viscosity polar lubricants when sought to be combined with the relatively low viscosity carrier or vehicle to form a stable dispersion of the former in the latter. For better understanding this characteristic as claimed hereinafter, it is to be understood that the term "normally substantially insoluble and immiscible" as used in the appended claims means that no significant amount of the high viscosity polar lubricant for the purpose of the invention will dissolve in the relatively low viscosity carrier or vehicle, and that no significant amount of the former can be dispersed in the latter in a stable dispersion without the aid of an added dispersing agent or the use of mechanical dispersing devices. In this respect, the invention is particularly distinguishable from the invention of U.S. Pat. No. 4,042,515, in which the solubility of deep drawing dimers and/or trimers of carboxylic acids in mineral oil carriers is aided, where needed, by the addition of a solution promoting agent such as nonyl alcohol. The use of such an agent with the compositions of the present invention is counterproductive.

Although specific applications of the present invention have been disclosed in detail herein for illustrating presently preferred applications of the invention to the solution of specific lubrication problems, it will be recognized by those skilled in the art that the invention is not limited to such examples but, on the contrary, permits many obvious ingredient substitutions and processing variants in producing different metal articles from differing metal stocks to meet differing manufacturing and use problems and standards. Accordingly, it should be understood that the scope of the present invention includes the entire scope of the ensuring claims considered in the light of the foregoing specification.

What is claimed is:

1. The method of preparing a metal surface for subsequent working of the metal to fabricate articles therefrom, comprising:

(a) dispersing in an anhydrous liquid vehicle of relatively low viscosity a quantity of an anhydrous, relatively high viscosity, liquid, polar lubricant that is normally substantially insoluble and immiscible in said liquid vehicle to produce a suspension of a liquid polar lubricant in the liquid vehicle, and (b) applying a substantially continuous layer of said suspension to the metal surface to deposit therefrom onto the metal surface an ultra-thin film of the high viscosity liquid polar lubricant overlaid by a substantially continuous film of said liquid vehicle.

2. The method of claim 1 in which said liquid dispersion contains from about 2 to about 20 parts of said high viscosity liquid polar lubricant to 100 parts of said low viscosity liquid vehicle by weight.

3. The method of claim 2 in which said liquid dispersion is applied to the metal surface as a layer having a thickness between about 200 and about 500 microinch.

4. The method of claim 1, 2, or 3 in which an emulsifying agent is incorporated in said dispersion in an amount sufficient to stabilize the dispersion prior to its application to the metal surface but insufficient to prevent separation of the high viscosity polar lubricant from suspension in the low viscosity liquid vehicle after such application.

5. The method of claim 1, 2, or 3 in which the viscosity of said high viscosity polar lubricant is at least 1,000 cSt at 20° C. and the viscosity of said liquid vehicle does not exceed 100 cSt at 20° C.

6. The method of claim 1, 2, or 3 in which the viscosity of said high viscosity polar lubricant is at least 1,000 cSt at 20° C., the viscosity of said liquid vehicle does not exceed 100 cSt at 20°, and in which an emulsifying agent is incorporated in said dispersion in an amount sufficient to stabilize the dispersion prior to its application to the metal surface but insufficient to prevent separation of the high viscosity polar lubricant from suspension in the low viscosity liquid vehicle after such application.

7. A sheet metal workpiece which is to be subsequently worked to fabricate articles therefrom including a metal surface having applied thereto a layer of a metalworking lubricant composition, said metalworking lubricant composition consisting essentially of a dispersion of from about 2 to about 20 parts by weight of a liquid polar lubricant having a viscosity of at least 1,000 cSt at 20° C. constituting a discontinuous phase in 100 parts of an anhydrous hydrocarbon liquid vehicle having a viscosity no higher than 100 cSt at 20° C., said hydrocarbon liquid vehicle being one in which said polar lubricant is normally substantially insoluble and immiscible, said dispersion containing at least one emulsifying agent in a total amount sufficient to stabilize the dispersion for application to a metal surface but insufficient to prevent separation of the discontinuous phase from said vehicle upon application of the dispersion to a metal surface as a layer having a thickness up to about 500 microinch.

8. A sheet metal workpiece according to claim 7 in which said dispersion contains a minor proportion of a member of at least one of the classes of materials consisting of surfactants, coupling agents, and saponifiable oils for facilitating removal of the lubricant composition from the surface of a metal workpiece that has been deformed while coated with the lubricant composition.

9. A sheet metal workpiece according to claim 7 in which said dispersion contains a minor proportion of at least one rust-inhibiting agent.

10. A sheet metal workpiece according to claim 7 in which said dispersion contains a minor proportion of a member of at least one of the classes of materials consisting of surfactants, coupling agents, and saponifiable oils for facilitating removal of the lubricant composition from the surface of a metal workpiece that has been deformed while coated with the lubricant composition and contains a minor proportion of a rust-inhibiting agent.

11. A sheet metal workpiece composition according to claim 7, 8, 9 or 10 in which said liquid polar lubricant is selected from the class consisting of blow castor oil, melamine resins, polymerized long-chain fatty acids, chlorinated paraffin waxes, rosin oils, and polyalkylene glycols.

12. A sheet metal workpiece according to claim 7 in which said polar lubricant is a chlorinated paraffin wax.

13. A sheet metal workpiece according to claim 7 wherein said layer of lubricant composition has a thickness in the range of from about 200 to about 500 microinch.

14. A sheet metal workpiece according to claim 7 in which said polar lubricant is blown castor oil and said hydrocarbon liquid vehicle is a naphthenic mineral oil.

15. A sheet metal workpiece according to claim 7 in which said polar lubricant is a mixture of polymerized, long-chain fatty acids.

16. A sheet metal workpiece according to claim 7 in which said polar lubricant is a mixture of polymerized, long-chain fatty acids and said hydrocarbon liquid vehicle is a naphthenic mineral oil.

17. A sheet metal workpiece according to claim 12, 13, 14, 15 or 16 in which said dispersion contains a member of at least one of the classes of materials consisting of surfactants, coupling agents, and saponifiable oils for facilitating removal of the lubricant composition from the surface of a metal workpiece that has been deformed while coated with the lubricant composition.

18. A sheet metal workpiece as set forth in claim 7 wherein material of said discontinuous phase is split from said continuous phase and is present on said metal surface as an ultra-thin, adherent film overlaid by a thin film of material of said continuous phase.

19. A sheet metal workpiece as set forth in claim 18 wherein said ultra-thin, adherent film of material of said discontinuous phase has a thickness in the range of from about 50 to about 200 microinch.

* * * * *

UNITED STATES PATENT AND TRADEMARK OFFICE

CERTIFICATE OF CORRECTION

PATENT NO. : 4,374,168

DATED : February 15, 1983

INVENTOR(S) : Wesley J. Wojtowicz

It is certified that error appears in the above—identified patent and that said Letters Patent is hereby corrected as shown below:

Column 2, line 49, "composition" should be changed to read --compositions--;

Column 3, line 27, after "about" insert --50 to about--; and

Column 12, line 35, "blow" should be changed to read --blown--.

Signed and Sealed this

*Thirty-first* Day of *May 1983*

[SEAL]

*Attest:*

DONALD J. QUIGG

*Attesting Officer*

*Acting Commissioner of Patents and Trademarks*